US005809865A

United States Patent [19]

Ikeda et al.

[11] Patent Number: 5,809,865

[45] Date of Patent: Sep. 22, 1998

[54] PISTON-TYPE COMPRESSOR WITH REDUCED VIBRATION

[75] Inventors: Hayato Ikeda; Akira Nakamoto; Hisato Kawamura; Noriyuki Shintoku, all of Aichi-Ken, Japan

[73] Assignee: Kabushiki Kaisha Toyoda Jidoshokki Seisakusho, Japan

[21] Appl. No.: 800,891

[22] Filed: Feb. 13, 1997

[30] Foreign Application Priority Data

Feb. 15, 1996 [JP] Japan ..... 8-027974
Feb. 15, 1996 [JP] Japan ..... 8-027975

[51] Int. Cl.[6] ..... F01B 3/00

[52] U.S. Cl. ..... 92/71; 417/269

[58] Field of Search ..... 92/12.2, 71; 91/499, 91/500, 504, 505; 417/269, 270

[56] References Cited

U.S. PATENT DOCUMENTS 4,886,423 12/1989 Iwanami et al. ..... 92/122
5,002,466 3/1991 Inagaki et al. ..... 92/12.2
5,022,826 6/1991 Matsuda et al. ..... 417/270

FOREIGN PATENT DOCUMENTS 1-116292 5/1989 Japan .
1-160180 11/1989 Japan .

*Primary Examiner*—Thomas E. Denion
*Attorney, Agent, or Firm*—Woodcock Washburn Kurtz Mackiewicz & Norris LLP

[57] ABSTRACT

A compressor that is constructed for reduced vibration during operation includes a cylinder having at least three cylinder bores, pistons being respectively positioned in the cylinder bores, structure for reciprocating the pistons; and structure for defining a dead volume between each of the pistons and cylinder bores. The dead volumes are divided into at least two groups, which include a large dead volume group and a small dead volume group, and wherein the large dead volume group includes at least two cylinder bores, whereby vibration is reduced during operation.

19 Claims, 8 Drawing Sheets

COMPRESSION TORQUE VERSUS ONE OF THE COMPRESSION CHAMBERS

PISTON-TYPE COMPRESSOR WITH REDUCED VIBRATION

BACKGROUND OF THE INVENTION

1. Field of the Invention

This invention relates to a piston compressor of the type that is used, for example, in automotive air conditioning systems.

2. Description of the Related Technology

In one type of piston compressor that is in wide use at this time for automotive air conditioning systems, a drive shaft is supported for rotation within a crank shaft chamber that is defined within a housing. In a cylinder block that is formed within the housing are arranged a plurality of cylinder bores that are oriented so as to be generally parallel to the drive shaft. A cam plate is rotatably attached to the drive shaft such that the piston is reciprocally moved as the cam plate rotates in order to compress cooling gas in the compression chamber.

When the compressor is operated, a compression resistance force acts on each of the pistons as they compress the refrigerant gas. The compression resistance forces are transmitted to the drive shaft via the tilted plate, causing torque variations. The torque variations provide the shaft-clutch system with a variable force which create torsional vibrations. When the sum of torque variations, in other words, the sum of resistance generated in each of the compression chambers, is analyzed using a fast speed Fourier transform (FFT), a wide range, the 0-order to the very high order frequency components are obtained. The major components among these frequency components are the n-order rotation component which corresponds to the number (n) of cylinders. When frequencies such as the n-order rotation component are close to the level of unique vibrations of peripheral machines connected to the compressor, noise occurs due to resonance, increasing the noise level in vehicles.

To resolve these problems, Japanese utility model publication H1-160180, for example, discloses a variable capacity compressor having a movable tilted plate wherein dead volumes for the compression chambers in a part of cylinder bores are varied when the structure arranges cylinder bores unevenly. The dead volume is defined as the volume of a compression chamber when a piston reaches the upper dead point. In this piston compressor, the dead volume is formed only by reducing the piston surface by a predetermined length. In the compression chamber whose dead volume is increased, the transition curves for volumes and pressures are changed according to the increase in dead volume. Then, the compression resistance generated in the compression chamber is reduced and the sum of the compression resistance working on a movable tilted plate is maintained constant all the time, thus reducing the chance of generating torsional vibration and noise.

However, the abovementioned publication discloses only the fact that the dead volumes for a part of cylinder bores are changed. In other words, there is no mention or suggestion of any counter measure which controls the torque variation for a drive shaft. As a result, insufficient reduction of torque variation is provided, providing the possibility of obtaining an insufficient reduction of noise and vibration.

The object of this invention is to provide a piston compressor which generates little noise and vibration by reducing the n-order rotation torque variation, or the vibration force which provides the torsional vibrations corresponding to the number (n) of cylinders.

SUMMARY OF THE INVENTION

In order to achieve the above and other objects of the invention, a compressor that is constructed for reduced vibration during operation includes, according to a first aspect of the invention, a cylinder having at least three cylinder bores; a plurality of pistons, the pistons being respectively positioned in the cylinder bores; structure for reciprocating the pistons; and structure for defining a dead volume between each of the pistons and cylinder bores, the dead volumes being divided into at least two groups which include a large dead volume group and a small dead volume group, and wherein the large dead volume group includes at least two cylinder bores, whereby vibration is reduced during operation.

According to a second aspect of the invention, a piston compressor in which a drive shaft is supported and a crank chamber is formed within a housing, and in a cylinder block constituting a part of the housing are arranged a plurality of cylinder bores around the drive shaft, and wherein a piston is reciprocally movably contained in the cylinder bores to form separate compression chambers, and a cam plate is rotatably attached integral with the drive shaft such that the piston is reciprocally moved as the cam plate rotates to compress cooling gas, wherein each of the compression chambers has a predetermined dead volume, and at least two of each compression chambers within the surface on which cylinder bores are arranged constitute a group of large dead volume compression chambers whose dead volumes are set larger than other compression chambers; while the other compression chambers constitute a group of small dead volume compression chambers; wherein the difference in the dead volumes between the large and small dead volume compression chambers is set to be larger than the difference in dead volume values within each of the dead volume compression chamber groups, and the small dead volume compression chambers are arranged on both sides of the large dead volume compression chambers.

According to a third aspect of the invention, a method for minimizing vibration in a piston type compressor that has at least three compression chambers includes steps of: providing a large group having at least two large volume compression chambers; providing a small group having at least one small volume compression chamber; and wherein the differences in volume between any compression chamber in the large group and any compression chamber in the small group is greater than any differences in volume among compression chambers within the large group or among compression chambers within the small group, whereby vibration of the compressor is reduced during operation.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 2(*b*) is a cross-sectional view taken along lines 2*b*—2*b* in FIG. 1;

DETAILED DESCRIPTION OF THE PREFERRED EMBODIMENT(S)

Figure 1:
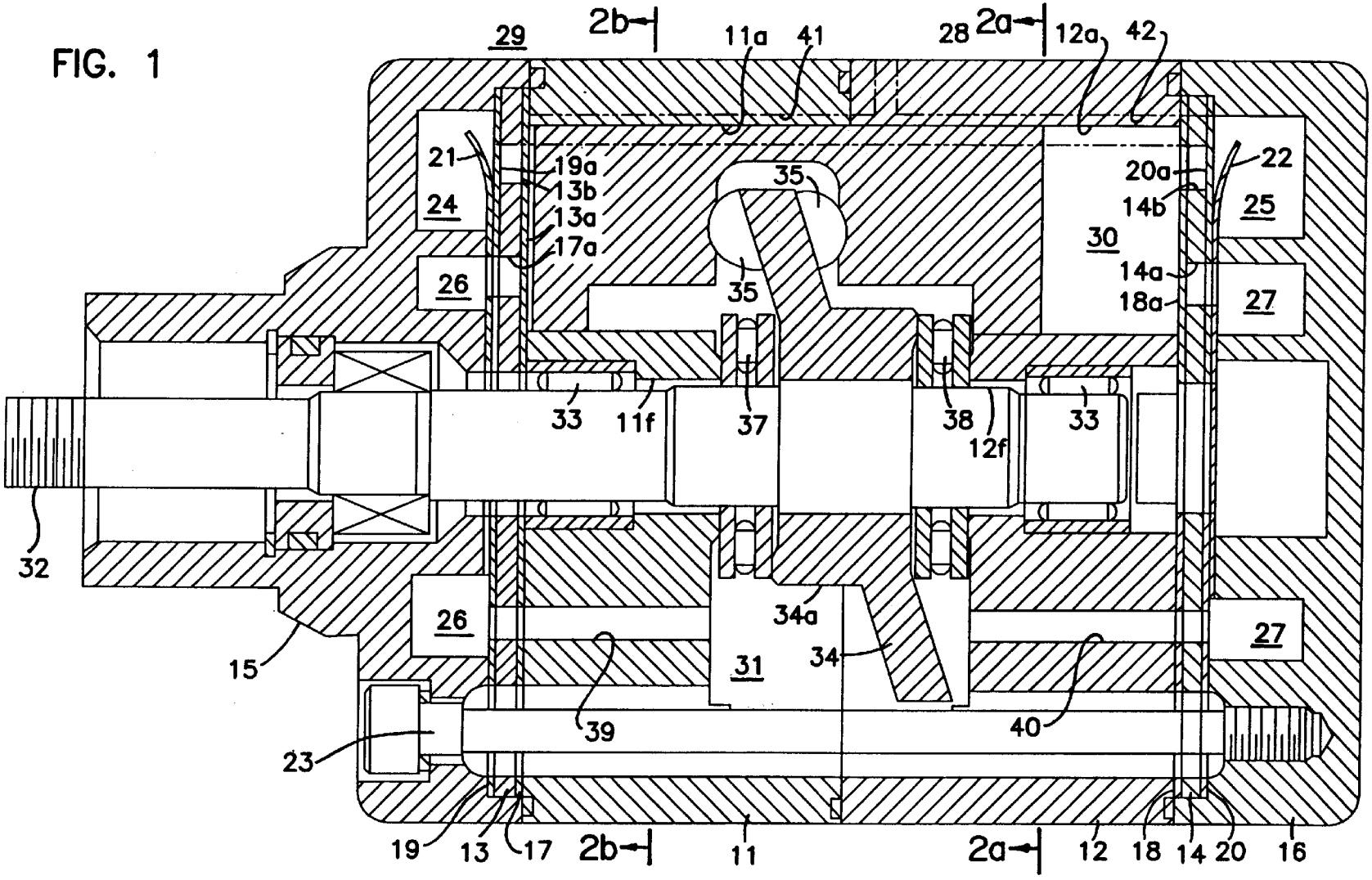
FIG. 1 is a cross-sectional view taken through a compressor that is constructed according to a preferred embodiment of the invention.

Referring now to the drawings, wherein like reference numerals designate corresponding structure throughout the views, and referring in particular to FIG. 1, a front side cylinder block 11 and a rear side cylinder block 12 are joined at the center portion. On the front side end surface of the cylinder block 11 is joined a front housing 15 via a valve plate 13 and on the rear side end surface of the cylinder block 12 is joined a rear housing 16 via a valve plate 14.

Between the aforementioned cylinder block 11 (12) and the valve plate 13 (14) is arranged an intake valve forming plate 17 (18) which forms an intake valve 17*a* (18*a*). Between the valve plate 13 (14) and the front (rear) housing 15 (16) is arranged a discharge valve forming plate 19 (20) which forms a discharge valve 19*a* (20*a*). Between the discharge valve forming plate 19 (20) and the front (rear) housing 15 (16) is arranged a retainer plate 21 (22) which regulates the maximum opening for the aforementioned discharge valve 19*a* (20*a*).

The aforementioned a cylinder block 11, 12, front housing 15, rear housing 16, valve plates 13, 14, intake valve forming plates 17, 18, and discharge valve forming plates 19, 20 are tightly fixed to each other with a plurality of bolts to form a housing for a compressor.

On the inner circumference of the aforementioned front housing 15 and rear housing 16 are separately formed discharge chambers 24, 25; and in the center of the housing are separately formed intake chambers 26, 27.

Figure 2A:
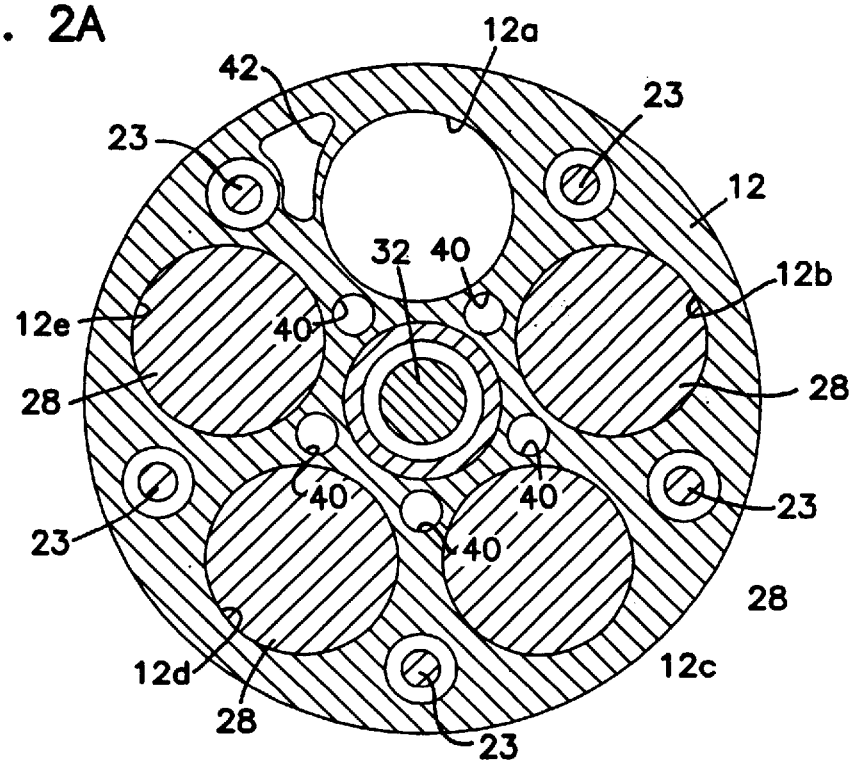
FIG. 2(*a*) is a cross-sectional view taken along lines 2*a*—2*a* in FIG. 1.
Figure 2B:
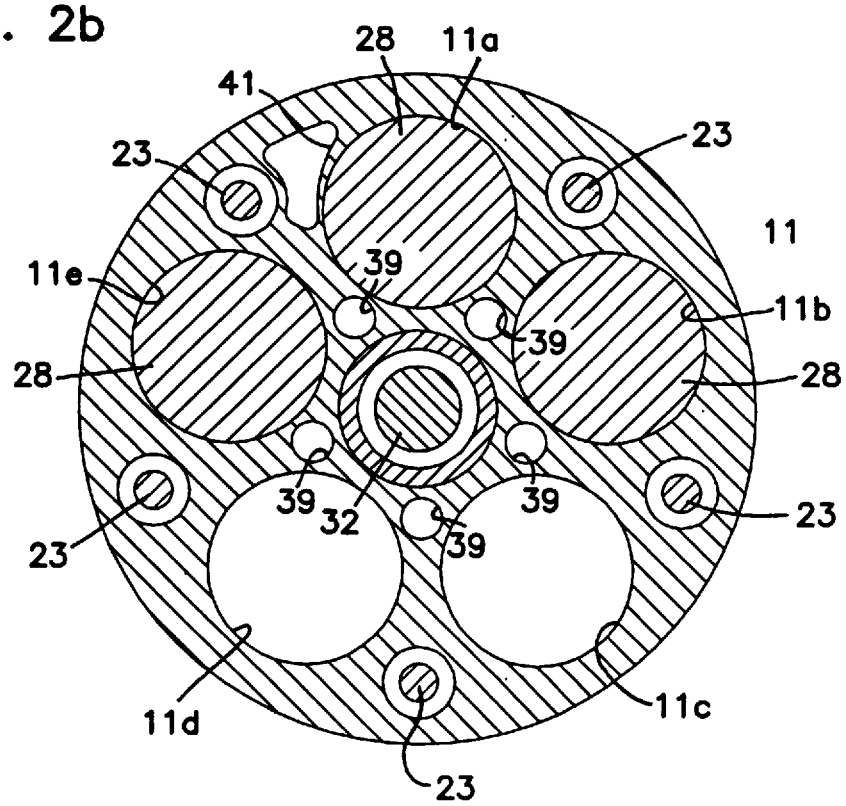

As illustrated in FIGS. 1 and 2, a plurality of cylinder bores 11*a* to 11*e* and 12*a* to 12*e* are inserted in parallel into the aforementioned cylinder block 11, 12 and a twin-head piston 28 is inserted into each of the cylinder bores. Note that the compressor of this embodiment is a piston compressor having 10 cylinders with five twin-head pistons 28.

In the aforementioned cylinder bores 11*a* to 11*e*, 12*a* to 12*e* are separately formed front and rear compression chambers 29, 30. These compression chambers 29, 30 are connected to intake chambers 26, 27 via intake ports 13*a*, 14*a* formed on the valve plates 13, 14 while in the same manner, are connected to discharge chambers 24, 25 via discharge ports 13*b*, 14*b* formed on the valve plates 13, 14.

In the center portion of the aforementioned two cylinder blocks 11, 12 is formed a crank chamber 31. In the shaft holes 11*f*, 12*f* of the two cylinder blocks 11, 12 is rotatably supported a drive shaft 32 via a pair of radial bearings 33. The drive shaft 32 is rotated using an external drive source such as automobile engine via a clutch which is not illustrated, but which is well known in this area of technology. In the mid circumference of the aforementioned drive shaft 32, fixed a tilted plate 34 which works as a cam plate. On the tilted plate 34 are engaged the aforementioned twin-head pistons 28 via shoes 35, 36 such that the twin-head piston 28 reciprocally moves within the cylinder bores 11*a* to 11*e*, 12*a* to 12*e* arranged around the drive shaft 32.

The boss section 34*a* of the aforementioned tilted plate 34 is supported via thrust bearings 37, 38 by the two front and rear wall surfaces of cylinder blocks 11, 12 which form the aforementioned crank chamber 31.

The aforementioned crank chamber 31 is communicated with intake chambers 26, 27 via intake passages 39, 40 formed in cylinder blocks 11, 12. The crank chamber 31 is connected to an external cooling circuit, which is not illustrated, via an intake flange which is also not illustrated but formed in the cylinder blocks 11, 12. In addition, the aforementioned discharge chambers 24, 25 are connected to an external cooling circuit via valve plates 13, 14, discharge passages 41, 42 formed in cylinder blocks 11, 12, and an discharge flange which is not illustrated.

In this embodiment, the inner diameter is identical for each of the aforementioned cylinder bores 11*a* to 11*e*, 12*a* to 12*e*. The two heads on the front and rear sides of the twin-head piston 28 contained in cylinder bores 11*b*, 11*d*, 12*b*, 12*d* are reduced only by a predetermined length. Therefore, when each of the piston 28 reaches the upper dead point, the distance between the head surface of the piston 28 and the outer end surfaces of cylinder bores 11*a* to 11*e*, 12*a* to 12*e* differ, within the surface on which cylinder bores 11*a* to 11*e*, 12*a* to 12*e* are arranged (11*a* to lie only for the front side; 12*a* to 12*e* only for the rear side,) between the group in which the head of piston 28 is reduced and the group in which the head of the piston 28 is not reduced. Therefore, the dead volumes for inside each of the compression chambers are set at two values, large and small. Here, the dead volume is the volume of the compression chambers 29, 30 when the piston 28 reaches the upper dead point.

Now, the dead volume in each of the rear side compression chambers 30 is described.

Figure 3A:
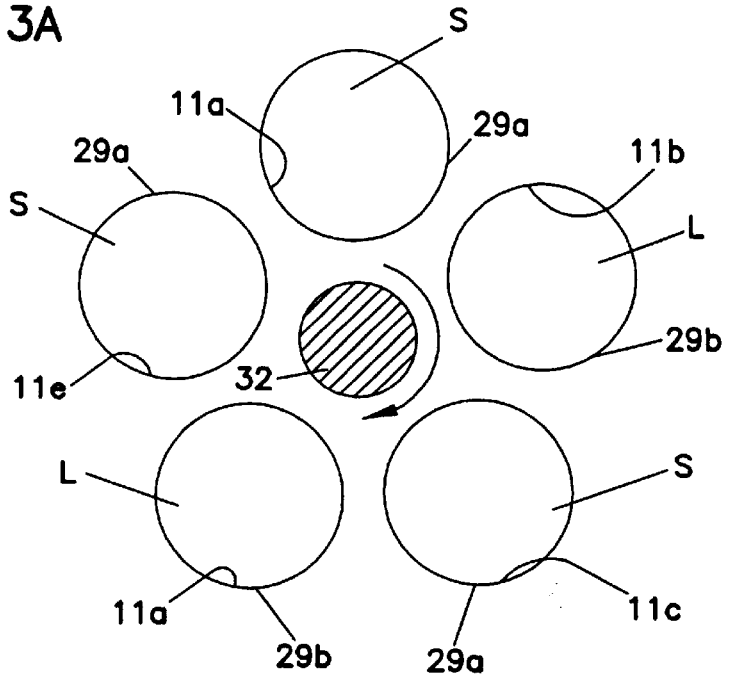
FIG. 3 is a schematic diagram illustrating an arrangement of various compression chambers in the embodiment of FIGS. 1 and 2, showing (a) a front side view; and (b) a rear side view.
Figure 3B:
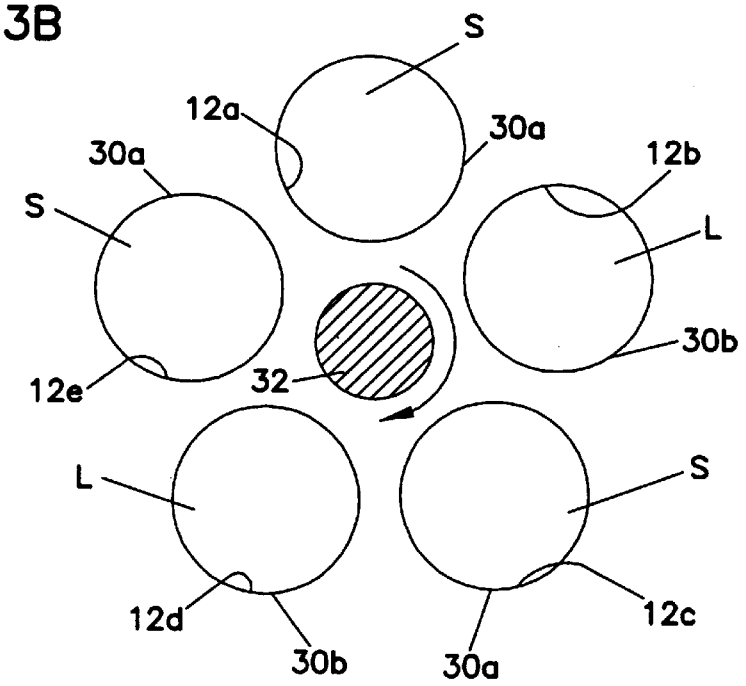

As illustrated in FIGS. 1 through 3, in cylinder bores 12*a*, 12*c*, 12*e*, a twin-head piston 28 whose head is not reduced is contained therein to decrease the dead volume for the compression chamber 30. That is, a small dead volume compression chamber 30*a* whose dead volume is set small is formed inside cylinder bores 12*a*, 12*c*, 12*e*. Also, in cylinder bores 12*b*, 12*d* contained is a twin-head piston whose head is reduced to increase the dead volume for the compression chamber 30. That is, a large dead volume compression chambers 30*b* whose dead volume is set large is formed inside cylinder bores 12*b*, 12*d*. Then, the compression chamber 30 inside each of the cylinder bores 12*a* to 12*e* is separated into the group of large dead volume compression chambers 30*b* and the group of small dead volume compression chambers 30*a*. In addition, the large dead volume compression chambers 30*b* in each of the cylinder bores 12*b*, 12*d* are arranged such that they are continually arranged in the direction in which the compression chambers 30 are arranged.

Figure 4A:
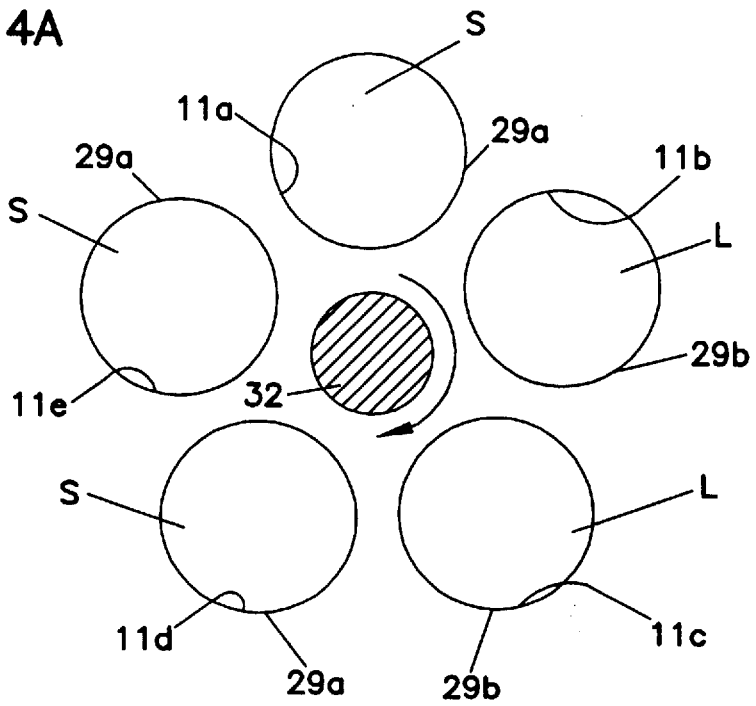
FIG. 4 is a schematic diagram illustrating a different arrangement of various compression chambers, showing (a) a front side view; and (b) a rear side view.
Figure 4B:
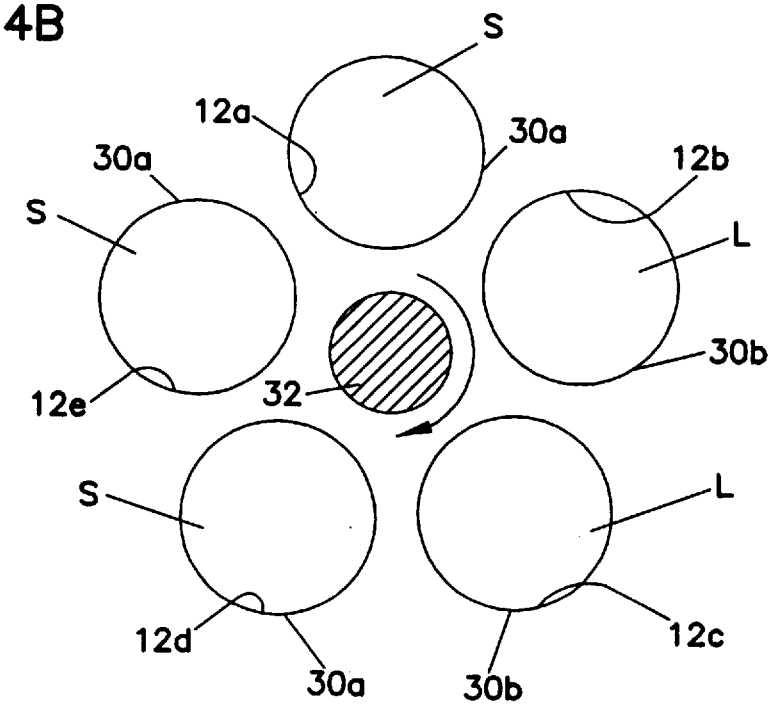

In the embodiment of FIG. 3, each side of the compressor includes three small volume compression chambers (S) and two large volume compression chambers (L), and these are arranged in a pattern L-S-S-L-S. In the embodiment of FIG. 4, there are also three small volume compression chambers (S) and two large volume compression chambers, and these are arranged in a different pattern, S-S-S-L-L. The two embodiments provide slightly different results, as will be discussed below, but are equally within the scope of the invention.

The difference between the dead volume value for the aforementioned large dead volume compression chamber 30*b* and that for the aforementioned small dead volume compression chamber 30*a* is set to be larger than the difference among the dead volumes in each group. In this embodiment, there is no difference between the large dead volume compression chambers 30*b* and in the same manner, there is no difference in small dead volume compression chambers 30*a*. Also, within a group, the values of the minimum dead volume in the large dead volume compression chamber 30*b* group are set to be about 2 to about 7 times, preferably about 2.5 to about 6 times larger, more preferably, about 3 to about 5.5 times larger than the values of the maximum dead volume of the small dead volume compression chamber 30*a*.

Moreover, among each of the aforementioned compression chambers 30, the difference in values [between] the maximum dead volume and the minimum dead volume in each of the compression chambers exists within the range of 1% or more to 10% or less than the volume of the compression chamber 30 at the lower dead point of a compression chamber having a minimum dead volume (hereafter referred to as a base intake volume). Note that preferable settings are within the range of about 3 to about 7%, more preferably, within the range of about 3.5 to about 5.5%. In a compressor of this embodiment, when the aforementioned base intake volume is, for example, 20 cc, the dead volume in the large dead volume compression chamber 30*b* is increased, for example, by 0.8 cc compared to that of small dead volume compression chamber 30*a*. The change in dead volume is about 4% of the aforementioned base intake volume.

The front and rear sides of the aforementioned twin-head piston 28 are reduced by an identical amount. Therefore, the dead volume in the front side compression chamber 29 and that of the rear side compression chamber 30 for a twin-head piston 28 are the same. In other words, the compression chambers 29 in cylinder bores 11*a* and the compression chambers 30 in cylinder bores 12*a* arranged opposite each other in the shaft direction of the drive shaft 32 are set to have the same dead volumes via the twin-head piston 28. In the same manner, the dead volume for each of the compression chambers 20 and 30 are the same in cylinder bores 11*b* and 12*b*, 11*c* and 12*c*, and 11*d* and 12*d*, 11*e* and 12*e*. As a result, the arrangement of the front side large dead volume compression chambers 29*b* and small dead volume compression chambers 29*a* is the same as that of the rear side large dead volume compression chambers 30*b* and small dead volume compression chambers 30*a* in the rotation direction of the drive shaft 32.

When the drive shaft 32 is rotated by means of the external drive source such as automobile engine, the tilted plate 34 in the crank chamber 31 is rotated and a plurality of twin-head pistons 28 are reciprocally moved in cylinder bores 11*a* to 11*e*, 12*a* to 12*e* via shoes 35, 36. The cooling gas 31 which has been pumped into the crank chamber 31 from an external cooling circuit, which is not illustrated, by the movement of the twin-head piston 28, is again led into intake chambers 26, 27 via intake passages 39,40 from the crank chamber 31. In the re-expansion/intake step in which the twin-head piston 28 heads from upper dead point to the lower dead point, intake valves 17*a*, 18*a* are opened as the pressure in compression chambers 29, 30 decrease, the cooling gas in intake chambers 26, 27 is taken into compression chambers 29, 30 via intake ports 13*a*, 14*a*.

Next, in the compression/discharge step when the twin-head piston 28 heads from the lower dead point to the upper dead point, the cooling gas in the compression chambers is compressed. When the cooling gas reaches a predetermined pressure, the compressed high pressure cooling gas pushes out the discharge valves 19*a*, 20*a* to discharge the gas to discharge chambers 24, 25 via discharge ports 13*b*, 14*b*. In addition, the compressed cooling gas in discharge chambers 24, 25 is supplied via the discharge passages 41, 42 and a discharge flange which is not illustrated to condensation apparatus, expansion valve, evaporation apparatus forming an external cooling circuit to provide air conditioning to vehicles.

Figure 11:
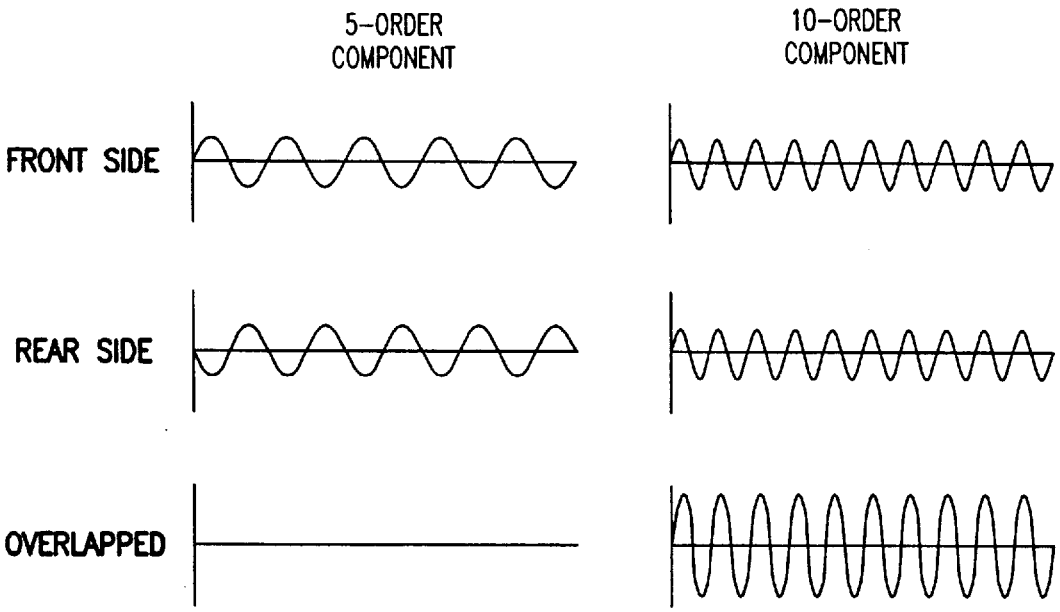
FIG. 11 is a graph showing the overlap phenomena between the front side sum and rear side sum of (a) the 5-order rotation component, and (b) the 10-order rotational component.

As illustrated in FIG. 11, in the twin-head piston compressor with 10 cylinders of identical dead volumes, the difference in the compression resistance phase is 180° between the front side sum and the rear side sum. Now, the 10-order rotation component, obtained as the n-order rotation component by analyzing the sum of compression resistance of each compression chambers using a fast Fourier transform, has a periodical normal wave profile which repeats even times. Therefore, the front side sum and the rear side sum of the 10-order rotation components conform to overlap their phases, consequently the 10-order rotation component of the torque variation derived from the compression resistance in each of the compression chambers completely overlaps to provide a major component of torsional vibration force between the drive shaft 32 and a clutch which is not illustrated.

In this case, the 5-order rotation component as the (n/2) -order rotation component repeats the same variation within a time unit equivalent to a rotation of the drive shaft 32. The difference in the compression resistance phase is 180° between the front side sum and the rear side sum for the 5-order rotation component and they cancel each other.

Figure 10:
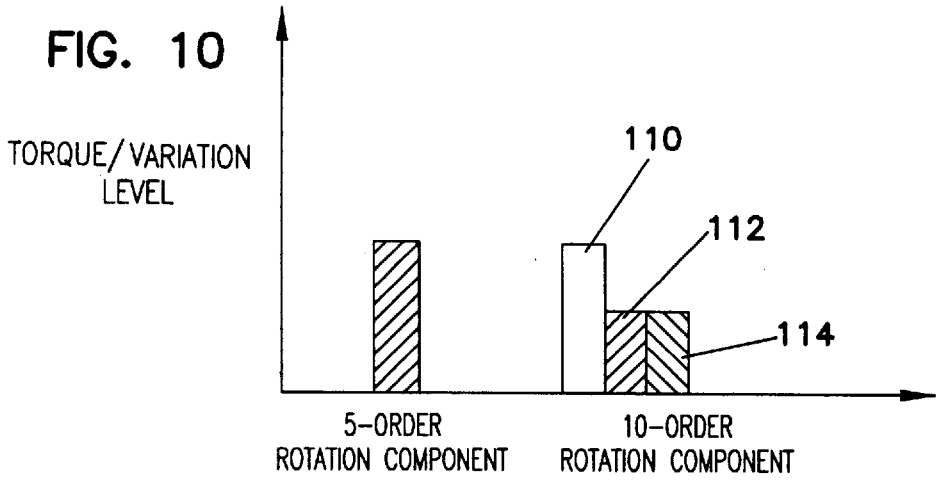
FIG. 10 is a graph showing the reduction in the 10-order rotation component and the change in the 5-order rotation component.

Now, when different dead volumes are given to the front and the rear sides of the twin-head piston 28 to reduce the aforementioned 10-order rotation component, as illustrated in FIG. 10, the front side sum and the rear side sum will provide different phases, decreasing the 10-order rotation component. Also in the 5-order rotation component, the same as the 10-order rotation component, the front side sum and the rear side sum will also provide different phases, providing new overlaps. This may let the 5-order rotation component of the torque variation be another cause for noise. In FIG. 10, the reference numeral 110 indicates where all dead volumes are the same, 112 indicates where the dead volume is changed for the front and rear sides of the same piston, and 114 represents the present invention.

Figure 5:
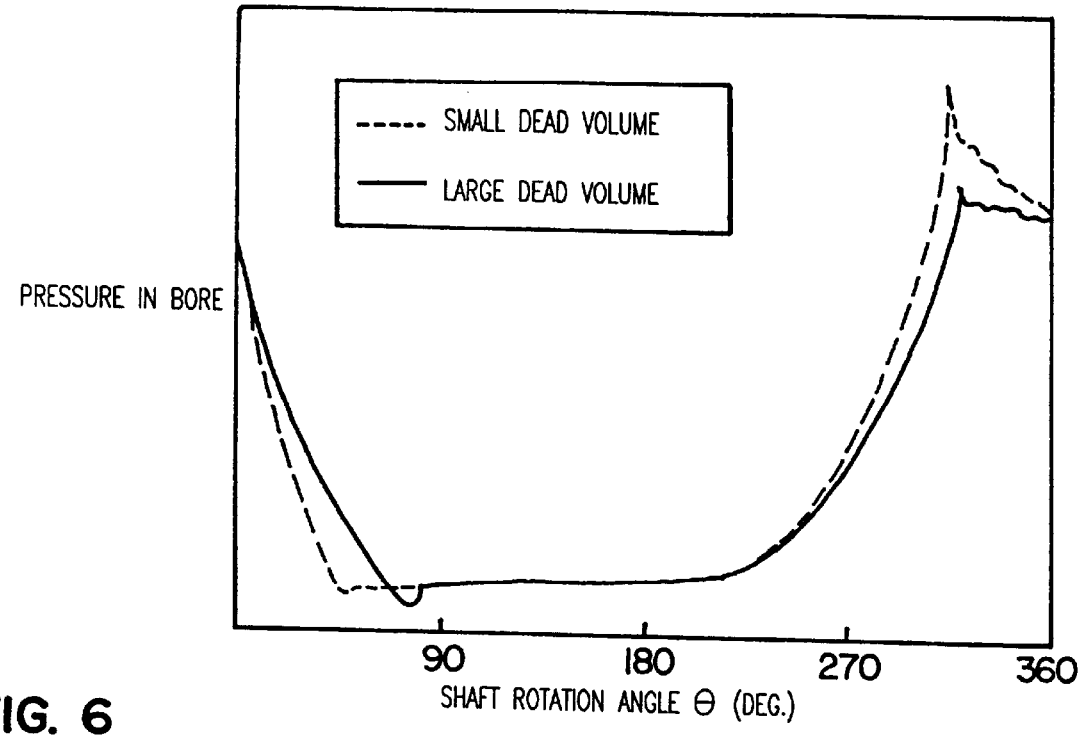
FIG. 5 is a graph showing the relationship between the shaft rotation angle and the inner pressure that is created within a bore.

As a countermeasure for the problem, the compressor of this invention is different from the conventional technology in that on both front and rear sides, dead volume values for each compression chambers 29, 30 are varied such that they basically can be divided in two groups. Adjacent to both sides of large dead volume compression chambers 29*b*, 30*b*, are arranged compression chambers 29*a*, 30*a*. Along with the change in the dead volumes for each of the compression chambers 29, 30, the transition curves for the volume and pressure change. That is, as illustrated in FIG. 5, the different timing for pressure transition in compression chambers 29, 30 is caused between the small dead volumes and large dead volumes in the re-expansion and compression processes. Also, the measured pressure for the maximum compression in the compression process will be different.

Figure 6:
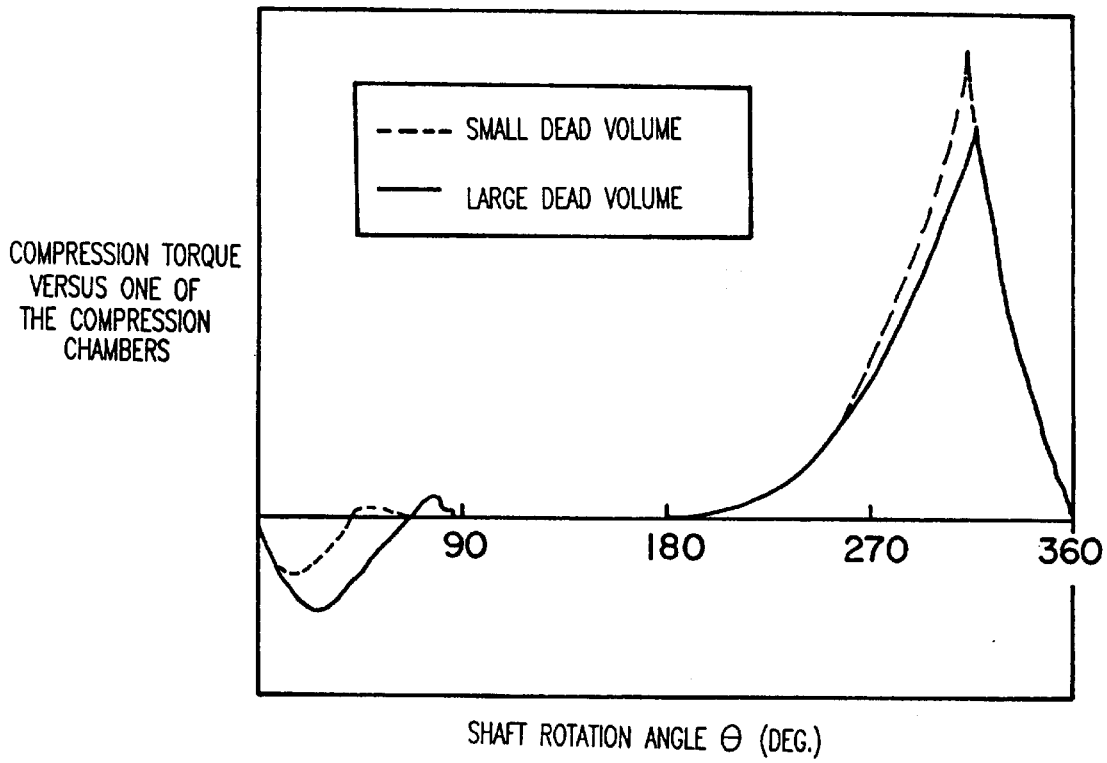
FIG. 6 is a graph showing the relationship between the shaft rotation angle and compression torque that is created within a compression chamber.
Figure 7:
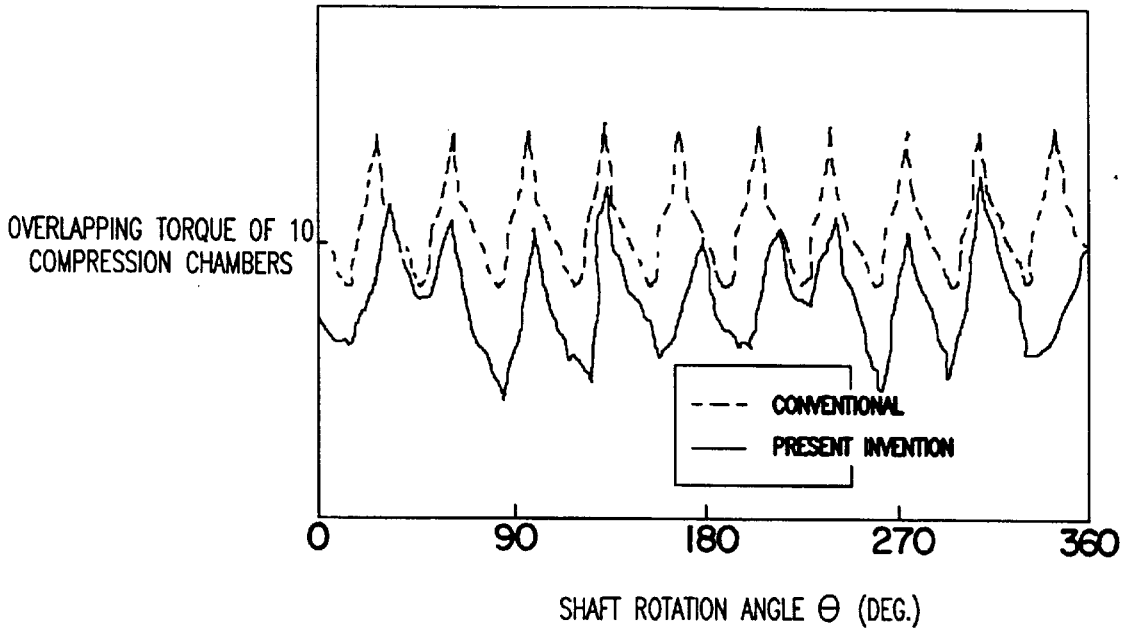
FIG. 7 is a graph showing the relationship between the shaft rotation angle and the compression torque for the entire compressor in the embodiment of FIG. 3, in which 10 compressor chambers are overlapped.
Figure 9:
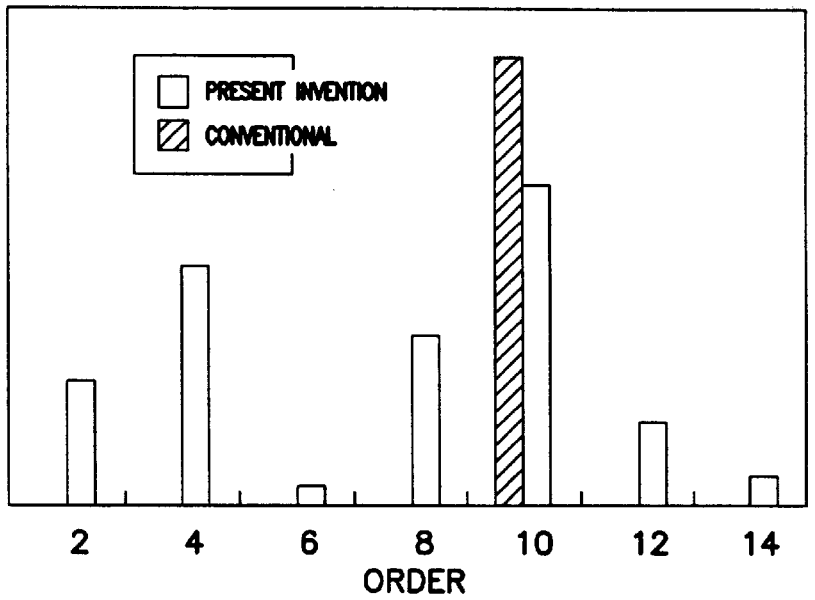
FIG. 9 is a graph showing the order components for compression torque.
Figure 8:
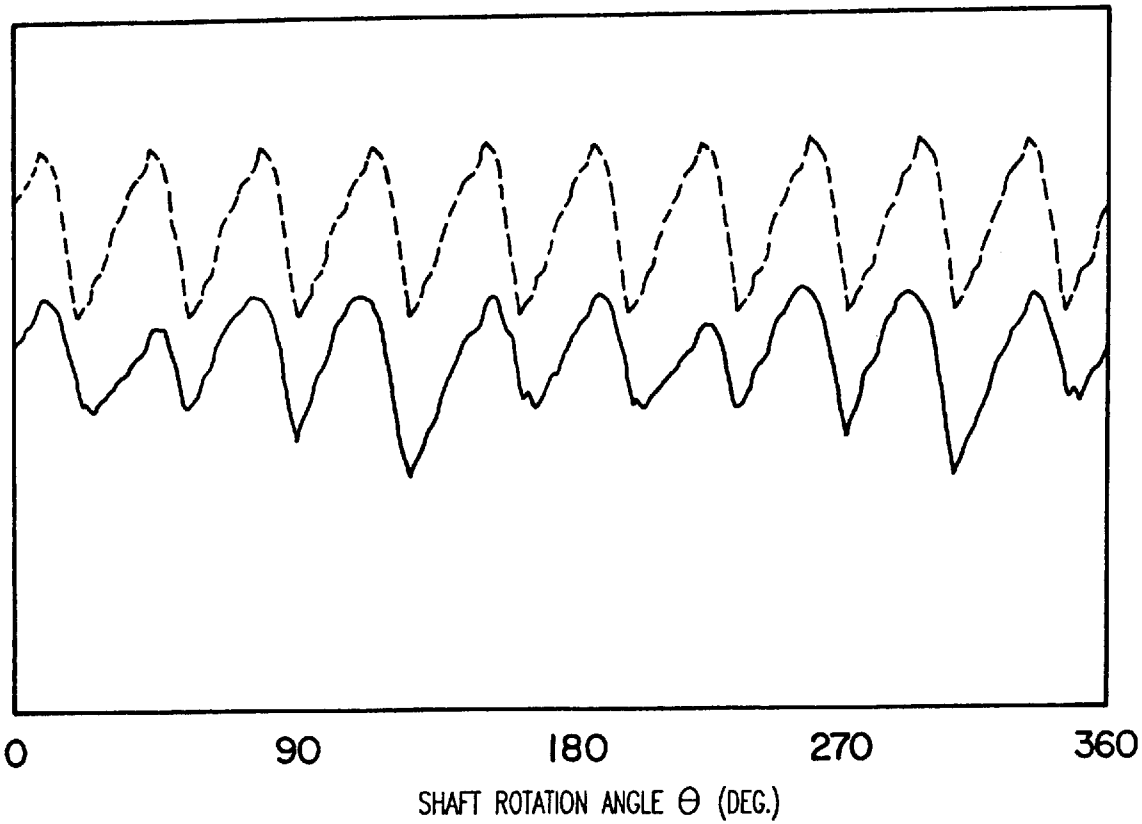
FIG. 8 is a graph showing the relationship between the shaft rotation angle and the compression torque for the entire compressor in the embodiment of FIG. 4, in which 10 compressor chambers are overlapped.

For this, as illustrated in FIG. 6, comparing chambers with small dead volumes with chambers with large dead volumes, the peak points are different on the transition curves for the compression torque versus one of the large dead volume compression chambers 29, 30. Therefore, when dead volumes are different for compression chambers 29, 30 compared to when no dead volumes are different, as illustrated in FIG. 7 for the embodiment of FIG. 3 and in FIG. 8 for the embodiment shown in FIG. 4, the compression torque of the entire compressor, overlapping torques of 10 compression chambers 29, 30 loses the regularity of the torque transition profile, reducing the level of the entire torque. Consequently, as illustrated in FIG. 9, the 10-order rotation component which corresponds to the number of cylinders is decreased; this is obtained by analyzing the sum of compression resistances using a fast Fourier transform.

The manufacturing tolerance for each of the components which form a compressor is different and it is difficult to provide the same assembly tolerance for all products. The variation in dead volume derived from the assembly tolerance is, being estimated at its minimum, less than 1% with respect to the aforementioned base intake volume. On the other hand, the compressor of this embodiment, a difference which is equivalent to 4% of the base intake volume exists between the aforementioned maximum dead volume and minimum dead volume. Even taking the aforementioned assembly tolerance into account, the tolerance can be afforded for the aforementioned change in dead volumes. In addition, the increase in dead volume of this level will not decrease the compression efficiency very much.

Also, the dead volumes in the front and rear side compression chambers 29 and 30 are formed in the same size for a twin-head piston. Therefore, the difference in the compression resistance phase of 180° is maintained between the front side sum and the rear side sum in the 5-order rotation component to cancel each other.

According to this embodiment of the aforementioned configuration, the following excellent effects are obtained:

(a) on both front and rear sides, dead volume values for each of the compression chambers 29, 30 are varied such that they basically can be divided in two groups. Adjacent to both sides of the large dead volume compression chambers 29*b*, 30*b* are arranged small dead volume chambers 29*a*, 30*a*. With these, the 10-order rotation component, the major component for the torque variation which works as the torsion vibration is reduced in the 10-cylinder twin-head piston compressor. Therefore, the aforementioned torsion vibration reduces the noise level generated by the compressor and the peripheral machines connected to it which may cause a resonance phenomena, consequently reducing the noise level in automobiles.

(b) the difference in the dead volumes between the large dead volume compression chambers 29*b*, 30*b* and small dead volume compression chambers 29*a*, 30*a* are set to be larger than the difference in dead volume values within each of the dead volume compression chamber groups, and the small dead volume compression chambers are arranged on both sides of the large dead volume compression chambers. The dead volumes for the large dead volume compression chambers 29*b*, 30*b* are set to be about 2 to about 7 times larger than those of small dead volume compression chambers 29*a*, 30*a*, preferably about 2.5 to about 6 times, more preferably about 3 to about 5.5 times. Also, the difference in values between the maximum dead volume and the minimum dead volume in each of the compression chamber groups is about 4% of the base intake volume in small dead volume chambers 29*a*, 30*a* having the maximum dead volume. Therefore, in the compressor of this embodiment, even taking the aforementioned assembly tolerance into account, [the tolerance] can afford the aforementioned change in dead volumes, reducing the degradation of compression performance of the compressor due to the change in dead volume.

(c) The dead volumes for front side compression chambers 29 and for rear side compression chambers 30 of a twin-head piston 28 are formed to be identical. In this case, in the 5-order rotation component, the front side sum and rear side sum cancel each other. Therefore, combined with the effects of the aforementioned (a) and (b), the 10-order rotation component of the torque variation can be reduced while controlling the generation of a 5-order rotation component.

(d) The dead volumes for large dead volume compression chambers 29*b*, 30*b* are set by reducing the both sides of the twin-head piston 28. Therefore, in setting dead volumes, the tolerance for the set values can be increased, thus changing the dead volumes for each of the compression chambers 29, 30 can be done easily.

This invention can also be actualized by the following modifications.

(1) The change in each of the compression chambers 29, 30 is done by forming recesses on heads of the twin-head piston 28.

(2) The change in each of the compression chambers 29, 30 is done by forming grooves on heads of the twin-head piston 28.

(3) The change in each of the compression chambers 29, 30 is done by forming notches on the inner circumferences of cylinder bores 11*a* to 11*e*, 12*a* to 12*e*.

(4) The change in each of the compression chambers 29, 30 is done by changing the length of cylinder bores 11*a* to 11*e*, 12*a* to 12*e*.

(5) The change in each of the compression chambers 29, 30 is done by changing the thickness of the valve plates 13, 14.

(6) Change the dead volumes for compression chambers 29, 30 by changing the thickness of the intake valves 17*a*, 18*a*.

With such simple configurations as mentioned in (1) through (6), dead volumes for each of the compression chambers 29, 30 can be changed easily.

(7) Practice this invention by using a twin-head piston compressor with a number of cylinders other than the ones described above, for example, 6, 8, 12 cylinders.

(8) At front side and rear side, vary the dead volumes for each large dead volume compression chambers 29, 30 in a plurality of types or make each of them different. Note that this change in dead volumes may be arbitrarily or automatically set based on the manufacturing tolerance of each component such as the piston 28.

(9) Maintain the difference between the minimum dead volume and maximum dead volume at 1%, the lowest limit, and 10%, the highest limit, of the base intake volume.

(10) Set the aforementioned base intake volume to a value other than those described above.

(11) Change more than two types of dead volumes on only one side of the front or rear side compression chambers 29 or 30 respectively.

(12) Actualize this invention using a one-head piston compressor.

With the configuration described in (11) and (12), the n-order rotation component corresponding to the number (n) of cylinders can be reduced.

(13) Actualize this invention using a wave cam plate type piston compressor.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A compressor that is constructed for reduced vibration during operation, comprising:

a cylinder having at least three cylinder bores;

a plurality of pistons, said pistons being respectively positioned in the cylinder bores;

means for reciprocating said pistons; and means for defining a dead volume between each of said pistons and cylinder bores, the dead volumes being divided into at least two groups which include a large dead volume group and a small dead volume group, and wherein the large dead volume group includes at least two cylinder bores, whereby vibration is reduced during operation.

2. A compressor according to claim 1, wherein said large dead volume group is arranged so that large dead volume cylinders within said group are arranged so as to be positioned next to each other.

3. A compressor according to claim 1, wherein the large dead volume group is arranged so that large dead volume cylinders within said group are positioned between small dead volume cylinders of the small dead volume group.

4. A piston compressor according to claim 1, wherein the values of the minimum dead volume in the large dead volume group is set to be about 2 to about 7 times larger than the values of the maximum dead volume for the small dead volume group.

5. A piston compressor according to claim 1, wherein the values between the maximum dead volume and the minimum dead volume in each of said compression chambers is different by 1% or more of the volume of a compression chamber having said minimum dead volume when it is at the lower dead point.

6. A piston compressor according to claim 1, wherein the values between the maximum dead volume and the minimum dead volume in each of said compression chambers is different by 10% or more of the volume of a compression chamber having said minimum dead volume when it is at the lower dead point.

7. A piston compressor according to claim 1, wherein the dead volumes within said large dead volume chamber group are different from each other.

8. A piston compressor according to claim 1, wherein said cylinder bores are formed such that a front and rear, face each other and said piston is formed in the two-head type to form predetermined dead volumes for each front and rear side compression chambers.

9. A piston compressor according to claim 8, wherein the front and rear dead volumes are formed in the same size for said two-head piston.

10. A piston compressor according to claim 1 wherein each of the dead volumes are provided by modifying the shape of said piston.

11. A piston compressor in which a drive shaft is supported and a crank chamber is formed within a housing, and in a cylinder block constituting a part of said housing are arranged a plurality of cylinder bores around said drive shaft, and wherein a piston is reciprocally movably contained in said cylinder bores to form separate compression chambers, and a cam plate is rotatably attached integral with said drive shaft such that said piston is reciprocally moved as said cam plate rotates to compress cooling gas, wherein each of said compression chambers has a predetermined dead volume, and at least two of each compression chambers on which cylinder bores are arranged constitute a group of large dead volume compression chambers whose dead volumes are set larger than the other compression chambers; while said other compression chambers constitute a group of small dead volume compression chambers; wherein the difference in the dead volumes between said large and small dead volume compression chambers is set to be larger than the difference in dead volumes within each of the dead volume compression chamber groups, and said small dead volume compression chambers are arranged on both sides of said large dead volume compression chambers.

12. A piston compressor according to claim 11, wherein the values of the minimum dead volume in said large dead volume compression chamber group is set to be about 2 to about 7 times larger than the values of the maximum dead volume for the small dead volume compression chamber group.

13. A piston compressor according to claim 11, wherein the values between the maximum dead volume and the minimum dead volume in each of said compression chambers is different by 1% or more of the volume of a compression chamber having said minimum dead volume when it is at the lower dead point.

14. A piston compressor according to claims 11, wherein the values between the maximum dead volume and the minimum dead volume in each of said compression chambers is different by 10% or more of the volume of a compression chamber having said minimum dead volume when it is at the lower dead point.

15. A piston compressor according to claim 11, wherein the dead volumes within said large dead volume chamber group are different from each other.

16. A piston compressor according to claim 11, wherein said cylinder bores are formed such that their front and rear face each other and said piston is formed in a two-head type to form each predetermined dead volumes for each front and rear side compression chambers.

17. A piston compressor according to claim 16, wherein the front and rear dead volumes are formed the same for said two-head piston.

18. A piston compressor according to claims 11, wherein each of the compression chamber dead volumes are provided by modifying the shape of said piston.

19. A method for minimizing vibration in a piston type compressor that has at least three compression chambers, comprising:

providing a large group having at least two large volume compression chambers;

providing a small group having at least one small volume compression chamber; and wherein the differences in volume between any compression chamber in said large group and any compression chamber in said small group is greater than any differences in volume among compression chambers within said large group or among compression chambers within said small group, whereby vibration of the compressor is reduced during operation.

* * * * *